US006520084B1

(12) United States Patent
Gelbart

(10) Patent No.: US 6,520,084 B1
(45) Date of Patent: Feb. 18, 2003

(54) METHOD FOR MAKING PRINTING PLATE USING INKJET

(75) Inventor: Daniel Gelbart, Vancouver (CA)

(73) Assignee: Creo Inc., Burnaby (CA)

( * ) Notice: Subject to any disclaimer, the term of this patent is extended or adjusted under 35 U.S.C. 154(b) by 0 days.

(21) Appl. No.: 09/780,055

(22) Filed: Nov. 13, 2000

(51) Int. Cl.[7] ..... B41C 1/00; B41N 1/12

(52) U.S. Cl. ..... 101/401.1; 101/395; 101/401; 347/103; 347/105; 347/106

(58) Field of Search ..... 101/395, 401, 101/401.1; 347/103, 101, 102, 104, 105, 106

(56) References Cited

U.S. PATENT DOCUMENTS

| | | | | | |
|---|---|---|---|---|---|
| 3,891,443 | A | * | 6/1975 | Halpern et al. | 101/395 |
| 4,961,154 | A | | 10/1990 | Pomerantz | 364/522 |
| 5,059,266 | A | | 10/1991 | Yamane | 156/64 |
| 5,072,671 | A | * | 12/1991 | Schneider et al. | 101/401.1 |
| 5,099,256 | A | * | 3/1992 | Anderson | 347/103 |
| 5,252,428 | A | * | 10/1993 | Kawamoto et al. | 101/401 |
| 5,287,435 | A | * | 2/1994 | Cohen et al. | 395/118 |
| 5,389,958 | A | * | 2/1995 | Bui et al. | 347/103 |
| 5,471,233 | A | * | 11/1995 | Okamoto et al. | 347/103 |
| 5,511,477 | A | * | 4/1996 | Adler et al. | 101/401.1 |
| 5,645,888 | A | | 7/1997 | Titterington et al. | 101/491 |
| 5,878,664 | A | * | 3/1999 | Hartka | 101/395 |
| 5,989,780 | A | | 11/1999 | Strong | 430/300 |
| 6,283,031 | B1 | * | 9/2001 | Kakuta et al. | 101/466 |

FOREIGN PATENT DOCUMENTS

| | | |
|---|---|---|
| JP | 2307728 | 12/1990 |
| JP | 2307730 A | 12/1990 |
| JP | 2307733 A | 12/1990 |

* cited by examiner

*Primary Examiner*—Stephen R. Funk
(74) *Attorney, Agent, or Firm*—Oyen Wiggs Green & Mutala'

(57) ABSTRACT

In accordance with the present invention an elastomeric printing plate, with a printing surface finish that allows it to be used in flexographic printing, is grown by a method based on an inkjet process. By employing two different materials, one used as a removable filler, the printing plate is grown in inverted orientation with its printing surface against a modifying surface that modifies the growth of the printing plate and, in particular, ensures that the raised image on the printing plate has a smooth surface finish. The present invention allows the generation of a flexographic printing plate in a short time without the need for high power $CO_2$ lasers and liquid processing steps.

30 Claims, 1 Drawing Sheet

METHOD FOR MAKING PRINTING PLATE USING INKJET

FIELD OF THE INVENTION

The invention relates to printing, and more specifically to flexographic printing and in particular to the fabrication of flexographic printing plates.

BACKGROUND TO THE INVENTION

In flexographic printing most plates are prepared by using a photo-polymer exposed through a mask. After exposure many steps are required to complete the preparation of a flexographic plate. For example, the unexposed polymer is washed away by brushing with a solvent, followed by extended drying. Another method of making flexographic plates uses direct ablation of the polymer with a high power $CO_2$ laser. This method is slow due to the large amount of material to be removed (about 1 kg of material removed from 1 $m^2$ of plate). There is therefore a need for lower cost, higher speed methods for the preparation of flexographic printing plates.

A range of technologies is now available to create three-dimensional structures directly from digital information. These techniques are most typically applied in the design-engineering field to create three-dimensional models as a part of the mechanical design process. Many of these techniques are very sophisticated such as stereo-lithography using lasers to expose a photo-sensitive resin which then hardens. One particular technique that lends itself to cost-effective fabrication of three-dimensional structures is a modified inkjet process.

Standard ink-jet processes typically employ water-based inks, although some systems operate using oil-based inks. Some ink-jet devices are of the type known as "solid ink jet" or "phase-change ink jet". In those types of ink jets the ink is solid at room temperature, becomes a liquid by heating it in the ink-jet head, and solidifies again when cooling down after being deposited on the printed substrate. The best known commercial example of "solid ink" jet is the product line made by Tektronics Inc. (Beaverton, Oreg.) and sold under the generic name "Phaser". These units use a multi-channel heated head to deposit droplets of molten wax on paper. Solid ink ink-jet deposition is not limited to planar objects. Small three-dimensional objects can be built-up by depositing many layers of molten polymer or wax. A commercial unit for building such small models is sold by 3D Systems (Valencia, Calif.) under the name Actua 2100. The brochure describing this system is hereby made of record.

The waxes and polymers used by the Tektronics units or the 3D Systems units are not suitable for flexographic plates. However, both the Tektronics Phaser and the 3D Systems Actua 2100 are very suitable for deposition of liquid elastomers as long as the elastomer reaches a sufficiently low viscosity at the working temperature of these units (100° C. to 150° C. range). Alternatively, a liquid may be ink-jetted, followed by post-curing. A well-known method of post-curing is the use of UV light to solidify inks based on photo-polymers.

A flexographic plate resembles a very large rubber stamp. A polyester back, typically 0.007" (0.17 mm) thick provides mechanical stability and an elastomeric raised image, having a typical relief of 0.006" to 0.04" (0.15 to 1 mm) provides the printing surface. Since each path of the Actua 2100 system builds up 0.001" to 0.004" of thickness, between 2 and 40 passes are required to build up the relief required for printing.

There is, however, a debilitating problem in applying elastomer-based inkjet techniques to the fabrication of flexographic printing plates. The flexographic printing process is remarkably sensitive to the detailed surface finish of the raised areas of the flexographic printing plate. Typical nominally flat surfaces grown by elastomeric ink-jet deposition do not meet the stringent surface finish requirements of the printing industry. In order for the economic benefits of inkjet deposition to be brought to bear on the printing industry, it is therefore necessary to make some critical adaptations to the established methods used with this technology.

It is an object of this invention to devise an inkjet-based plate-making process in which the quality of the printing surface is much higher than that achievable by a simple "build-up" of layers. Another object is to make the quality of the printing surface independent of deposition conditions.

BRIEF SUMMARY OF THE INVENTION

In accordance with the present invention an elastomeric printing plate, with a printing surface finish that allows it to be used in flexographic printing, is grown by a method based on an inkjet process. By employing two different materials, one used as a removable filler, the printing plate is grown in inverted orientation with its printing surface against a modifying surface that modifies the growth of the printing plate and, in particular, ensures that the raised image on the printing plate has a smooth surface finish. The present invention allows the generation of a flexographic printing plate in a short time without the need for high power $CO_2$ lasers and liquid processing steps.

DETAILED DESCRIPTION OF THE PREFERRED EMBODIMENT

Figure 1:
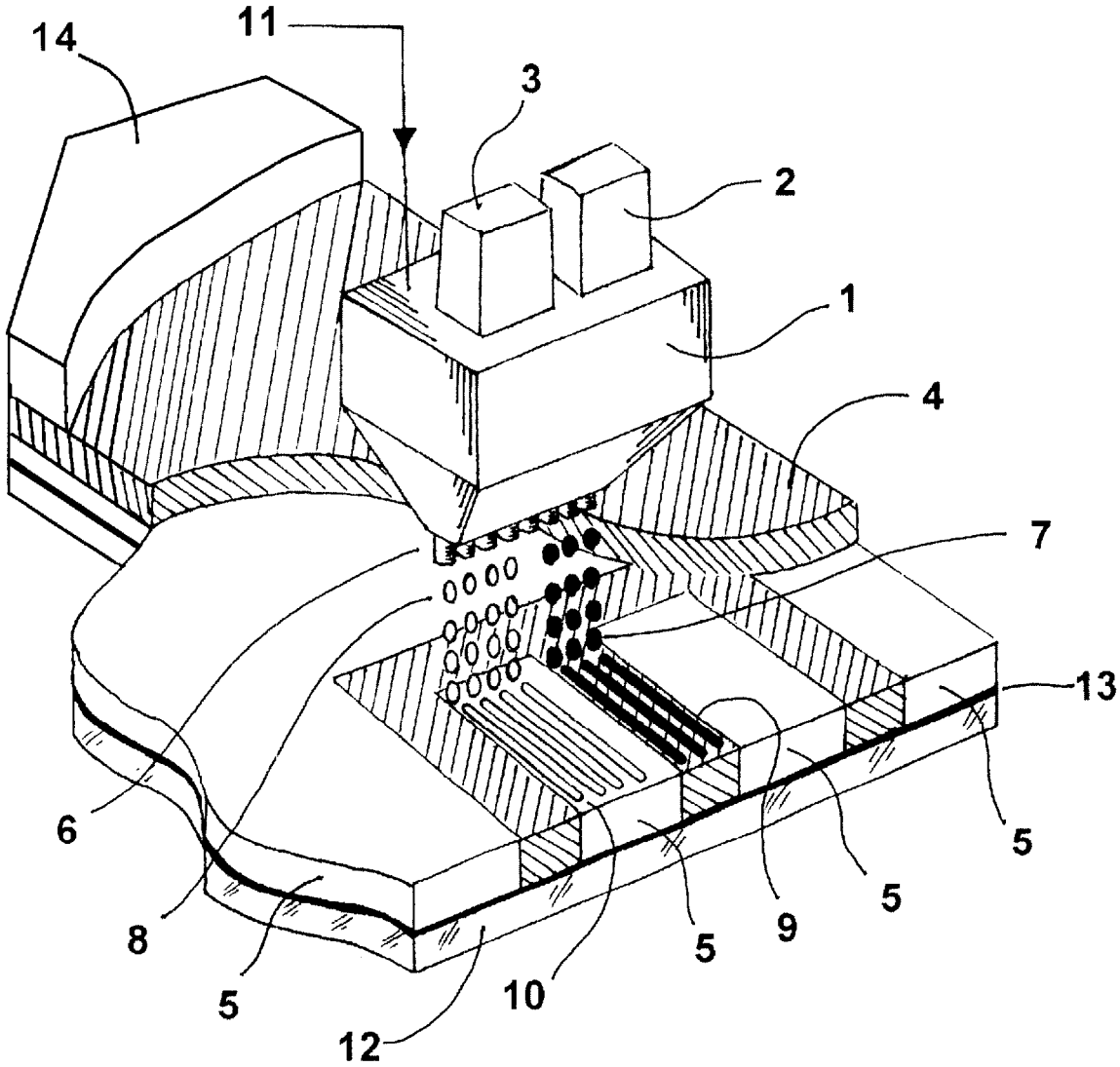
FIG. 1 shows schematically the process of building up a relief image on a flexographic printing plate by means of multiple passes of an ink-jet unit employing two different liquid elastomers that are deposited on a modifying surface.

FIG. 1 depicts the preferred embodiment of the invention. Referring therefore to FIG. 1, an inkjet head 1 uses two different materials, 2 and 3, in a liquid form. Only one of these materials needs to be an elastomer. Layers 4 and 5 are deposited on deposition-modifying surface 12. Deposition-modifying surface 12 may be glass and may optionally have a release coating 13 to facilitate the release of the grown structure at the end of the process. The two liquefied materials are ejected through different sets of inkjet nozzles 6 in the form of droplets 7 and 8 respectively and are deposited on surface 12 or 13, as the case may be, in the form of solidified lines 9 and 10 respectively. The inkjet nozzles 6 are controlled by digital data 11 representing the digitized image to be recreated.

The solidification step, after ink-jetting, can be effected by cooling down, chemical reaction, special environmental conditions, including radiation, or any combination of these. Materials 2 and 3 may also be supplied to the inkjet head 1 in liquid or solid form. The elastomer may also be of a type that, once deposited, sets, dries or cures in air or reacts with air to solidify. Exposure to UV radiation is also a common solidification process. The process to solidify the elastomer liquids may particularly include any polymer cross-linking process. Combinations may also be employed, such as using a low melting point elastomer that can be further strengthened by cross-linking. The cross-linking may be achieved by exposing the finished plate to radiation, such as ultraviolet (UV) or infrared (IR).

An example of an appropriate elastomer that may be liquefied by heating is meltable polyurethane and an example of a liquid form that solidifies to an appropriate elastomer by drying is a 10% solution of KRATONO® rubber (available from Shell Chemical Co., Toronto, Canada) type D-1125x in toluene. The toluene is allowed to evaporate between every two deposited layers.

The choice of the preferred method depends on the hardness (durometer) and degree of cross-linking (affecting strength and solvent resistance) which is required. The different examples illustrate the wide range of properties achievable. A wide range of UV-curable liquid elastomers is available. They are currently used as UV-curable elastomeric coatings for paper, fabric etc.

Elastomer 2, forming layer 4, is employed to deposit the structure that becomes, at the end of the completed process, the flexographic plate. Elastomer 3, forming filler layer 5, is a filler material with different physical and chemical properties from elastomer 2. This difference in properties is employed to facilitate the removal of filler layer 5. Filler material 5 can be water-soluble to facilitate cleanup. It can also be a material that evaporates or sublimates easily, such as naphtalene.

Layer 4 comprises both the image features of the flexographic plate and the base on which the image is formed. A critical aspect of this invention is the fact that the plate is grown image-first and then the base of the plate is grown. The purpose with use of a deposition-modifying surface such as glass, or glass coated with a release agent, is to enhance the surface uniformity of the printing surface of the printing plate. Without this aspect, the ink-jet based process does not generate adequate surface smoothness for use in the printing industry.

A further aspect of the preferred embodiment is that the deposition-modifying surface may be pre-treated to impart to it a special surface texture. Examples may be matte, orange-peel or any variation in appearance that is aesthetically pleasing or functionally useful. In this latter respect, the ink-bearing ability of a matte surface is very useful. The surface energy of a matte surface is considerably higher than that of a smooth surface of the same material. This increases the ability of that surface to bear ink.

A backing material 14 is added at the end in order to provide dimensional stability. The backing material, which is typically polyester, can be attached by the use of pressure sensitive adhesive before the plate is removed from deposition-modifying surface 12 or release coating 13. In some cases, when a very high degree of uniformity is required, the top layer of material 4 will need to be cut to the correct degree of flatness or material 14 added on top of a still liquid layer and pressed flat using a top forming surface (not shown).

An alternative method of applying backing layer 14 is lamination between deposition-modifying surface 12 and a flat surface, using adhesive capable of leveling out the remaining non-uniformities in layer 4.

The elastomeric inkjet printing process may have the deposition by nozzles 6 interleaved to obtain higher deposition resolution. The process described here is repeated in order to grow multiple layers and thereby to create a flexographic printing plate of the appropriate dimensions. FIG. 1 is schematic in the sense that, for the sake of clarity, it does not show the thickness of the imaged layer 4 and the thickness of the base layer 14 to scale. A typical base thickness is of the order of 0.007" (0.17 mm). As a typical thickness of one layer of droplets is about 0.002" (0.05 mm) while a typical relief of raised image 2 is about 0.01" (0.25 mm), at least 5 layers are needed to build up the raised image and 3 layers to deposit the base of the plate.

Dual-material ink-jet processes are known to those skilled in the art, although not applied to flexographic printing plates or with a surface modification aspect. An example is given in U.S. Pat. No. 5,059,266 disclosing the use of different colored materials in building a 3-dimensional object. Another example is the Quadra machine from the company Objet located in Rehovot, Israel. In employing this latter machine to render three-dimensional objects, the support material is stripped away to render the final product. While all existing three-dimensional inkjet machines claim a smooth surface finish, the special requirements of flexographic printing typically demand local surface variations of less than one micron in order to modulate the thickness of the ink layer, which is itself only a few microns thick.

What is claimed is:

1. A method of manufacturing a printing plate comprising a patterned printing surface and a backing, said method comprising:

providing a deposition-modifying surface;

forming a printing surface by depositing a pattern of a first material on said deposition-modifying surface;

applying a backing layer over said printing surface while said printing surface is on said deposition-modifying surface; and, removing said backing layer and printing surface from the deposition-modifying surface.

2. The method of claim 1 wherein forming said printing surface comprises depositing multiple layers of said first material onto said deposition-modifying surface.

3. The method of claim 2 wherein said first material comprises an elastomer, and said method comprises solidifying each of said multiple layers after depositing each of said multiple layers.

4. The method of claim 3 comprising solidifying each of said multiple layers before depositing a next one of said multiple layers.

5. The method of claim 3 comprising coating said deposition-modifying surface with a release agent before forming said printing surface on said deposition-modifying surface.

6. The method of claim 2 wherein depositing said pattern of said first material is performed by an ink jet process.

7. The method of claim 6 wherein said ink jet process comprises a solid ink type process wherein first material is converted to a liquid by melting.

8. The method of claim 6 wherein said ink jet process comprises a liquid ink type process, said first material comprises a radiation curable liquid and said method comprises radiation curing each of said multiple layers before depositing a next one of said multiple layers.

9. The method of claim 6 wherein said ink jet process comprises a liquid ink type process, said first material comprises a solute in a solvent and said method comprises after depositing each of said multiple layers, evaporating said solvent before a next of said multiple layers is deposited.

10. The method of claim 1 comprising applying a base layer by applying a plurality of layers of a base material using an ink jet printing process.

11. The method of claim 10 wherein said base layer has a thickness on the order of 0.007 inches.

12. The method of claim 1 wherein applying said backing layer comprises adhering a sheet of backing material to the printing surface with an adhesive.

13. The method of claim 1 wherein depositing said pattern of said first material is performed by an ink jet process.

14. The method of claim 1 wherein said first material comprises a radiation curable elastomer, and said method comprises radiation curing said printing plate after depositing said pattern of said first material.

15. The method of claim 1 comprising coating said deposition-modifying surface with a release agent before forming said printing surface on said deposition-modifying surface.

16. The method of claim 1 wherein forming said printing surface comprises:

depositing a second material on said deposition-modifying surface in places where said first material has not been deposited; and, removing said second material after depositing said printing surface.

17. The method of claim 16 comprising removing said second material after removing said printing surface from said deposition-modifying surface.

18. The method of claim 16 wherein forming said printing surface comprises depositing multiple layers of each of said first and second materials onto said deposition-modifying surface before removing said printing surface from said deposition-modifying surface.

19. The method of claim 18 wherein said first material comprises an elastomer, and said method comprises solidifying each of said multiple layers of said first material after depositing each of said multiple layers of said first material.

20. The method of claim 18 wherein said ink jet process comprises a liquid ink type process, said first material comprises a radiation curable liquid and said method comprises depositing multiple layers of said radiation curable liquid, and radiation curing each of said multiple layers before a next of said multiple layers is deposited.

21. The method of claim 16 wherein depositing said first and second materials is performed using an ink jet process.

22. The method of claim 21 wherein said ink jet process comprises a solid ink type process wherein at least one of said first and second materials is converted to a liquid by melting.

23. The method of claim 22 wherein said first material comprises a radiation curable elastomer, and said method comprises radiation curing said printing plate.

24. The method of claim 21 wherein said ink jet process comprises a liquid ink type process, said first material comprises a solute and a solvent, and said method comprises depositing multiple layers of said first material and, after depositing each of said multiple layers, evaporating said solvent before a next of said multiple layers is deposited.

25. The method of any one of claims 1, 2, 13 or 16 wherein said deposition-modifying surface is smooth and wherein said forming said printing surface comprises forming a smooth printing surface at an interface between said first material and said deposition-modifying surface.

26. The method of any one of claims 1, 2, 13 or 16 wherein said deposition-modifying surface is textured and wherein forming said printing surface comprises forming a textured printing surface at an interface between said first material and said deposition-modifying surface.

27. A method for making a patterned flexographic printing plate, the method comprising:

depositing on a deposition-modifying surface a printing surface comprising a pattern of a first material by sequentially applying a plurality of layers of the first material in the pattern; and, subsequently removing the printing surface from the deposition-modifying surface and using the removed printing surface as a plate for flexographic printing.

28. A method for making a patterned flexographic printing plate, the method comprising:

depositing on a deposition-modifying surface a printing surface comprising a pattern of a first material by sequentially applying a plurality of layers of the first material in the pattern; and, subsequently removing the printing surface from the deposition-modifying surface wherein depositing said printing surface comprises:

depositing a second material on said deposition-modifying surface in places where said first material has not been deposited; and, removing said second material after depositing said printing surface.

29. The method of claim 28 wherein depositing said pattern of said first material is performed by an ink jet process.

30. The method of claim 29 wherein said first material comprises an elastomer, and said method comprises solidifying each of said multiple layers of said first material after depositing each of said multiple layers of said first material.

* * * * *